US007238062B2

(12) United States Patent
Sun

(10) Patent No.: US 7,238,062 B2
(45) Date of Patent: Jul. 3, 2007

(54) KNOCKDOWN UNIVERSAL SERIAL BUS CONNECTOR

(75) Inventor: Zheng-Heng Sun, Tu-Cheng (TW)

(73) Assignee: Hon Hai Precision Industry Co., Ltd., Tu-cheng, Taipei Hsien (TW)

( * ) Notice: Subject to any disclaimer, the term of this patent is extended or adjusted under 35 U.S.C. 154(b) by 0 days.

(21) Appl. No.: 11/453,962

(22) Filed: Jun. 15, 2006

(65) Prior Publication Data

US 2007/0010137 A1 Jan. 11, 2007

(30) Foreign Application Priority Data

Jul. 9, 2005 (CN) ..... 2005 2 0061393

(51) Int. Cl.
*H01R 13/502* (2006.01)

(52) U.S. Cl. ..... 439/701

(58) Field of Classification Search ..... 439/701, 439/752.5, 708, 660

See application file for complete search history.

(56) References Cited

U.S. PATENT DOCUMENTS 5,941,733 A 8/1999 Lai
6,462,953 B2 * 10/2002 Tong et al. ..... 361/732
6,685,508 B2 2/2004 Zhu et al.
6,902,432 B2 6/2005 Morikawa et al.
6,908,324 B1 * 6/2005 Morley et al. ..... 439/218
2002/0193015 A1 * 12/2002 Milan ..... 439/752.5
2006/0028803 A1 * 2/2006 Pocrass ..... 361/737

* cited by examiner

*Primary Examiner*—Tulsidas C. Patel
*Assistant Examiner*—Phuongchi Nguyen
(74) *Attorney, Agent, or Firm*—Morris Manning & Martin LLP; Tim Tingkang Xia, Esq.

(57) ABSTRACT

A knockdown universal serial bus connector includes a first main body with a first plug formed thereon, a cable electronically connected to the first main body and the first plug, and a second main body with a second plug formed thereon. The second main body is slidably attached to the first main body. It is simple and economical to use the knockdown USB connector to link two USB ports to provide higher power for a higher-power USB device. After the second main body is detached from the first main body, the first main body can be a single USB connector to connect an external device to a personal computer.

10 Claims, 3 Drawing Sheets

KNOCKDOWN UNIVERSAL SERIAL BUS CONNECTOR

BACKGROUND OF THE INVENTION

1. Field of the Invention

The present invention relates in general to USB connectors, and more particular to a knockdown USB connector.

2. General Background

To facilitate the linking of various external peripheral devices with different system terminals, four major international companies (including Compaq, Intel, Microsoft and NEC) have developed the Universal Serial Bus (USB) interface in 1998. Ever since Microsoft Windows 98 operating system started to provide built-in program for driving USB interface peripheral devices, the use of these peripheral products is facilitated. As a result, the applications of USB products have been expanding gradually.

A USB interface can provide current as 500 milliamperes and pressure as 5 volts, and the providing power is 2.5 wattages. In the past, a USB connector may link only one USB port, and a higher-power USB device can not work normally in that case.

What is needed, therefore, is a USB connector that can link two USB ports and provide higher power to a device with USB interface.

SUMMARY

An exemplary knockdown universal serial bus connector includes a first main body with a first plug formed thereon, a cable electronically connected to the first main body and the first plug, and a second main body with a second plug formed thereon. The second main body is slidably attached to the first main body.

It is simple and economical to use the knockdown USB connector to link two USB ports to provide higher power for a higher-power USB device. And when the second main body is detached from the first main body, the first main body can be a single USB connector to connect an external device to a personal computer.

Other objects, advantages and novel features will become more apparent from the following detailed description when taken in conjunction with the accompanying drawings, in which:

DETAILED DESCRIPTION OF THE INVENTION

Figure 1:
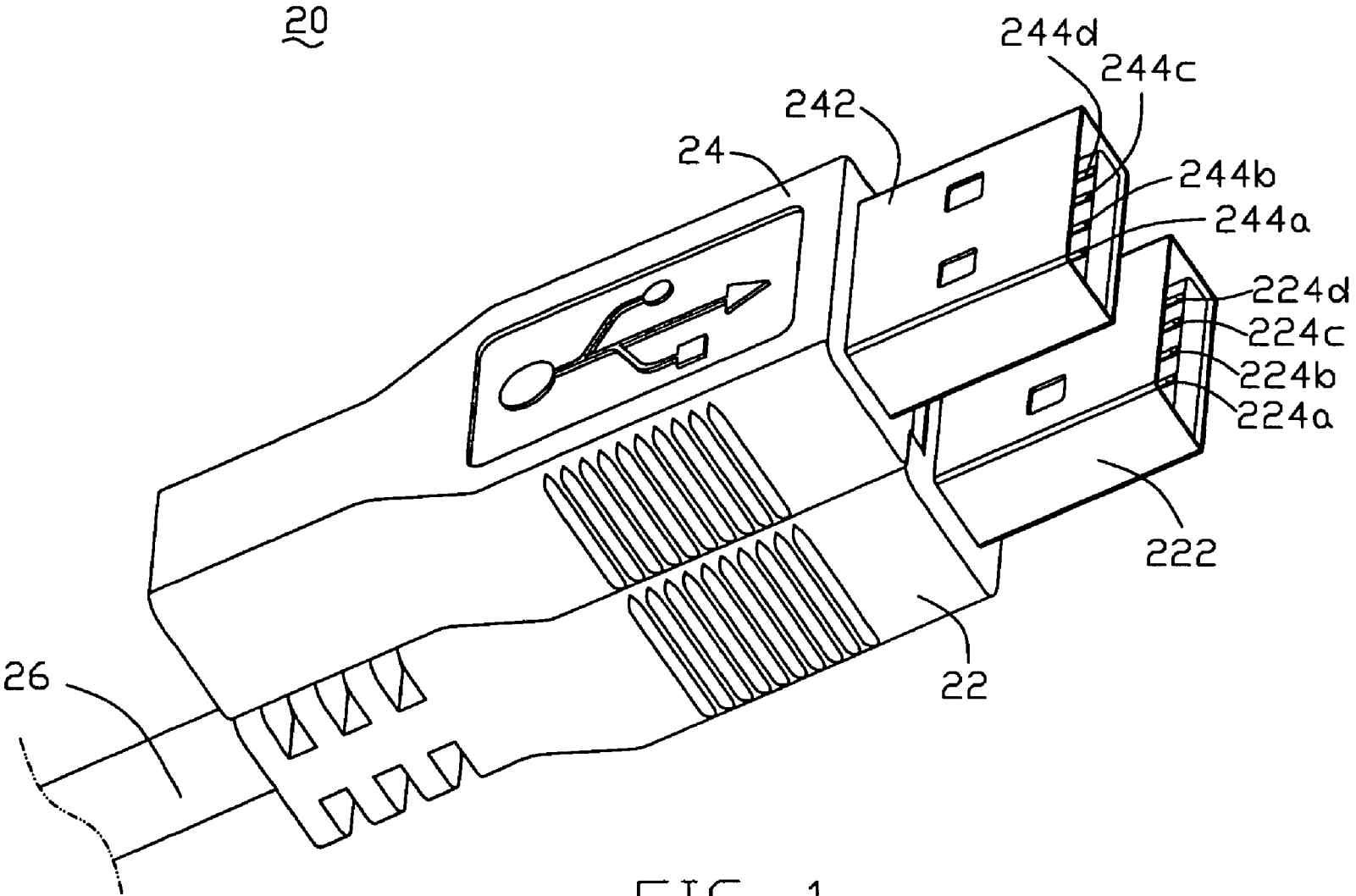
FIG. 1 is an isometric view of a knockdown USB connector according to one preferred embodiment of the invention.

FIG. 1 is an isometric view showing the structure of a USB connector of a connective assembly according to one preferred embodiment of the invention. As illustrated in FIG. 1, the knockdown connector 20 complying with the electrically connective standard, USB, includes a first main body 22, a second main body 24, and a cable 26 linked to the first main body 22. The first main body 22 includes a first plug 222 used as a first connective port, and the second main body 24 includes a second plug 242 used as a second connective port.

The first plug 222 includes four pins 224*a*~224*d*. The second plug 242 includes four pins 244*a*~244*d*. The pins 224*a* and 244*a* are VCC pins. The pins 224*d* and 244*d* are GND pins. The pins 224*b*, 224*c*, 244*b* and 244*c* are data pins. The electrical signals that the pins transmit are shown in the following table:

| PIN | SIGNAL |
|---|---|
| a | VCC(+5 V) |
| b | D− |
| c | D+ |
| d | Ground |

Figure 2:
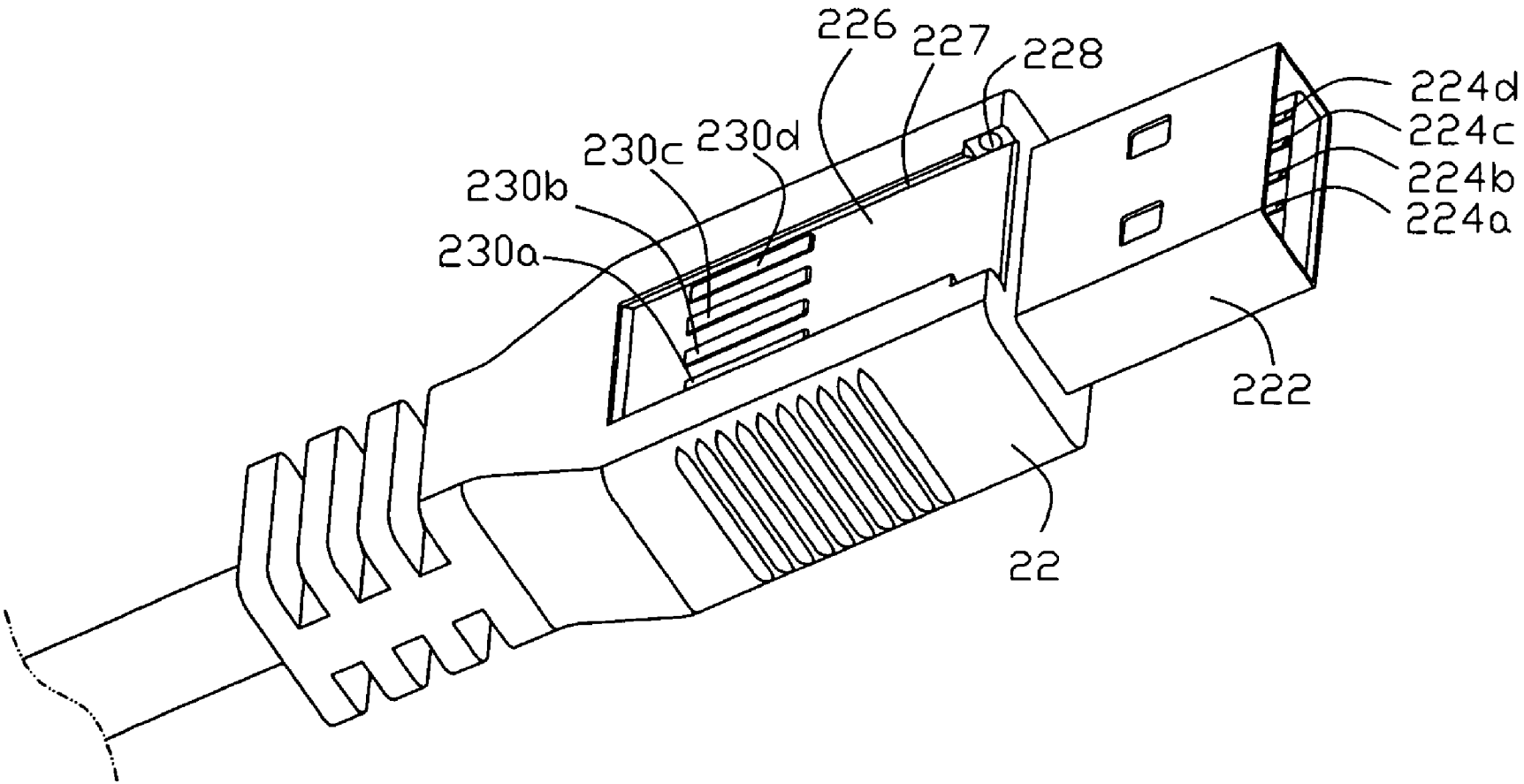
FIG. 2 is an isometric view of a first main body of FIG. 1.

Referring to FIG. 2, the first main body 22 includes a slot 226 defined in a middle portion of the first main body 22. Four conductive sheets 230*a*~230*d* are attached on the slot 226 and are electrically connected to the pins 224*a*~224*d* of the first plug 222 respectively so as to form a first side of a connective interface beside the first main body 22. The four pins 224*a*~224*d* are electrically connected to the cable 26. The slot 226 has two side walls 227, each side wall 227 is a slanted surface. The slot 226 has a dove-tail cross section. A locking hole 228 is defined in a front portion of each side wall 227.

Figure 3:
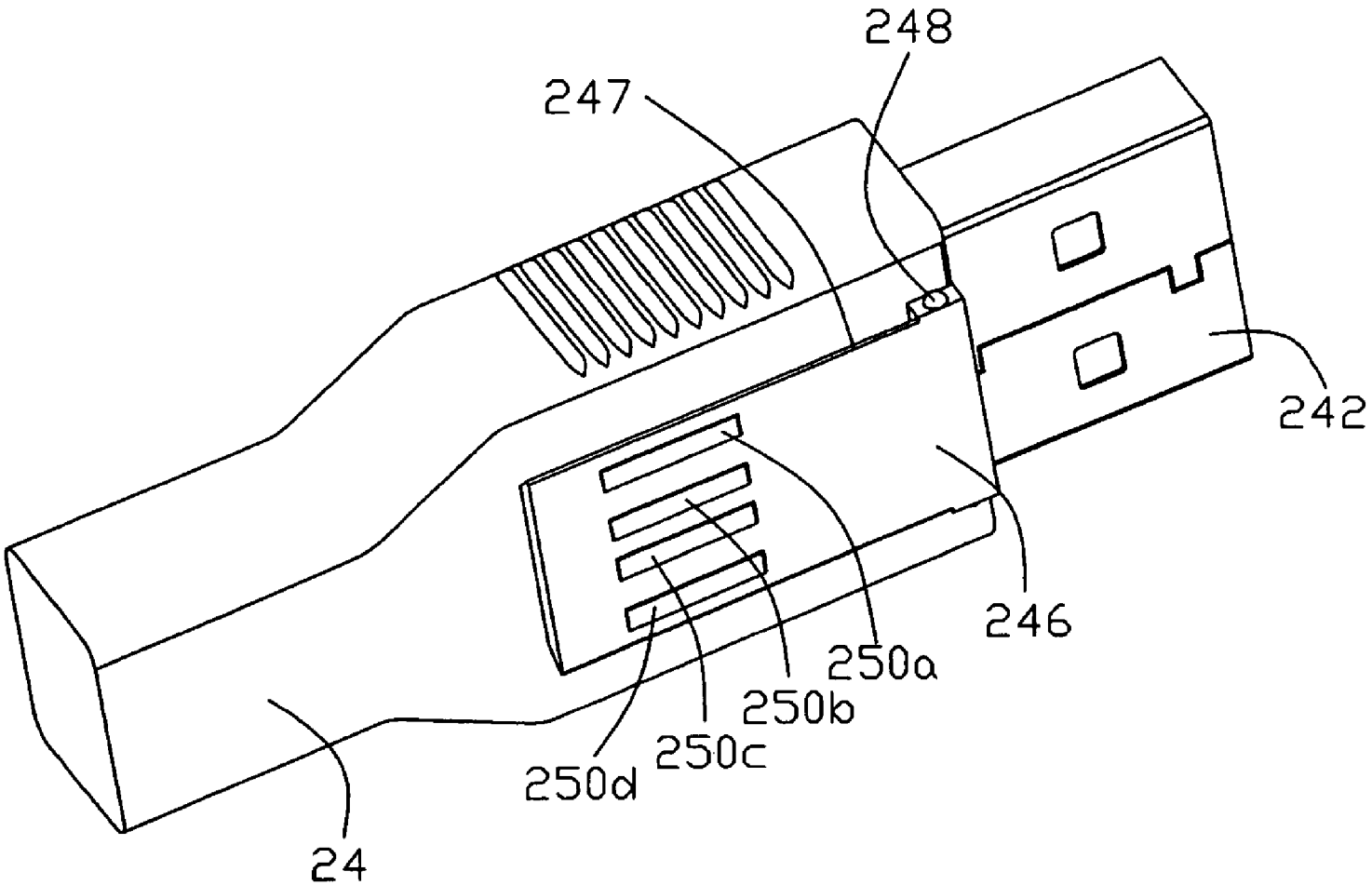
FIG. 3 is an isometric view of a second main body of FIG. 1.

Referring to FIG. 3, the second main body 24 has a projection 246 formed thereon. Four conductive sheets 250*a*~250*d* are attached on the projection 246 to form a second side of the connective interface beside the second main body 24. The pins 250*a* and 250*d* are electrically connected to the pins 244*a* and 244*d* of the second plug 242 respectively. The pins 250*b* and 250*c* are not connected to anything. The projection 246 has a dove-tail cross section corresponding to the slot 226. The projection 246 has two side plates 247, each side plate 247 is a slanted surface having substantially the same inclination as the surface of the side wall 227 for slidingly contacting with the side wall 227 of the first main body 22. A bulge 248 is formed on a front portion of each side plate 247 for engaging in the locking hole 228 thereby locking the second main body 24 to the first main body 22.

When the first main body 22 and the second main body 24 are locked together, the conductive sheets 230*a*~230*d* are electronically connected to the pins 250*a*~205*d* respectively. Therefore, the VCC pin 224*a* and the GND pin 224*d* of the first plug 222 are connected to the VCC pin 242*a* and the GND pin 242*d* of the second plug 224 through the connected conductive sheets. As the result, the knockdown USB connector 20 can provides twice of the current of a usual USB connector when it is working.

The second main body 24 is pushed outwardly from the first main body 22, the bugles 248 are disengaged from the locking holes 228, the second main body 24 is detached from the first main body 22, the first main body 22 can be a USB connector solely to connect external device to a personal computer. A cover plate having a dove-tail cross section is provided to matingly cover the slot 226 of the first main body 22 for protecting the conductive sheets 230*a*~230*d*.

It is to be understood, however, that even though numerous characteristics and advantages of the present embodiment has been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A knockdown universal serial bus (USB) connector comprising:

a first main body with a first plug formed thereon, wherein the first main body comprises a slot defined therein, the slot has two side walls, each side wall is a slanted surface with a locking hole defined in a front portion;

a cable electronically connected to the first main body and the first plug; and a second main body with a second plug formed thereon, the second main body slidably attached to the first main body;

wherein the first plug and the second plug each comprise four pins including a power pin, a ground pin, and two data pins.

2. The connector as claimed in claim 1, wherein four conductive sheets are attached on the first main body and electrically connected to the pins of the first plug respectively.

3. The connector as claimed in claim 1, wherein the second main body has a projection formed thereon, the projection has two side plates, each side plate is a slanted surface having substantially the same inclination as the surface of the side wall of the first main body, a bulge is formed on a front portion of each side plate for engaging in the locking hole of the first main body.

4. The connector as claimed in claim 3, wherein two conductive sheets are attached on the projection and are connected to the power pin and the ground pin of the second plug respectively.

5. A method for making a knockdown universal serial bus (USB) connector comprising the steps of:

providing a first main body with a first plug formed thereon, wherein the first main body comprises a slot defined therein, the slot has two side walls, each side wall is a slanted surface with a locking hole defined in a front portion;

connecting a cable to the first main body and the first plug respectively; and slidably attaching a second main body with a second plug formed thereon to the first main body;

wherein the first plug and the second plug each comprise four pins: a power pin, a ground pin, and two data pins.

6. The method as claimed in claim 5, wherein four conductive sheets are attached on the first main body and electrically connected to the pins of the first plug respectively.

7. The method as claimed in claim 5, wherein the second main body has a projection formed thereon, the projection has two side plates, each side plate is a slanted surface having substantially the same inclination as the surface of the side wall of the first main body, a bulge is formed on a front portion of each side plate for engaging in the locking hole of the first main body.

8. The method as claimed in claim 7, wherein two conductive sheets are attached on the projection and are connected to the power pin and the ground pin of the second plug respectively.

9. A connective assembly comprising:

a first main body of said connective assembly comprising a first connective port complying with an electrically connective standard to output electrical signals from said first main body, wherein the first main body comprises a slot defined therein, the slot has two side walls, each side wall is a slanted surface with a locking hole defined in a front portion thereof;

a second main body of said connective assembly physically separable from said first main body and removably attachable to said first main body, said second main body comprising a second connective port complying with said electrically connective standard to output said electrical signals from said second main body, and a connective interface defined between said first and second main bodies to electrically transmit said electrical signals between said first and second main bodies, wherein the second main body has a projection formed thereon, the projection has two side plates, each side plate is a slanted surface having substantially the same inclination as the surface of a corresponding one of the side walls of the first main body, a bulge is formed on a front portion of each side plate for engaging in the locking hole of the first main body; and a cable of said connective assembly electrically connectable with one of said first and second bodies in order to electrically transmit said electrical signal into and out of said one of said first and second bodies.

10. The connective assembly as claimed in claim 9, wherein said second main body is attached to said first main body by means of moving along a direction parallel to said connective interface.

* * * * *